United States Patent [19]

Tate, Jr. et al.

[11] Patent Number: 4,550,576

[45] Date of Patent: Nov. 5, 1985

[54] CENTER RAIL ASSEMBLY FOR REFRIGERATOR

[75] Inventors: Ralph Tate, Jr., Center Township, Vanderburgh County; John T. Woods, Scott Township, Vanderburgh County, both of Ind.

[73] Assignee: Whirlpool Corporation, Benton Harbor, Mich.

[21] Appl. No.: 651,901

[22] Filed: Sep. 19, 1984

[51] Int. Cl.[4] ..... F25D 11/02

[52] U.S. Cl. ..... 62/441; 62/447

[58] Field of Search ..... 62/441, 447; 312/214

[56] References Cited

U.S. PATENT DOCUMENTS

| | | | |
|---|---|---|---|
| 2,442,978 | 6/1948 | Jones | 62/447 X |
| 2,622,412 | 12/1952 | Staebler | 62/117.25 |
| 2,639,592 | 5/1953 | Philipp | 62/95 |
| 2,665,562 | 1/1954 | Pedigo | 62/447 X |
| 2,707,871 | 5/1955 | Mocey | 62/447 X |
| 3,107,592 | 10/1963 | Herndon, Jr. et al. | 62/180 |
| 3,263,440 | 8/1966 | Hellstrom | 62/441 X |
| 3,294,462 | 12/1966 | Kesling | 312/214 |
| 3,407,016 | 10/1968 | Kronenberger | 312/296 |
| 3,599,442 | 8/1971 | Hanson | 62/419 |
| 3,805,545 | 4/1974 | Buchser et al. | 62/443 |
| 4,056,211 | 11/1977 | Zumwalt | 220/9 G |
| 4,170,391 | 10/1979 | Bottger | 312/214 |
| 4,191,434 | 3/1980 | Powell et al. | 312/214 |
| 4,330,310 | 5/1982 | Tate, Jr. et al. | 62/275 |

*Primary Examiner*—Lloyd L. King

*Attorney, Agent, or Firm*—Wood, Dalton, Phillips, Mason & Rowe

[57] ABSTRACT

Sealing structure for preventing air flow across exposed metal portions of a center rail assembly in a refrigeration apparatus. The air flow preventing seals include sealing pads mounted to the side edges of a divider wall received in channels in the cabinet liner for preventing air flow through a front end of the channel. A second air flow preventing seal is provided in the form of a rope extending about each of the opposite ends of a center rail bracket received in inwardly opening roll-formed flange channels defined by the metal outer shell. The third air flow preventing seal is provided in the form of a sealing strip compressed between the front face of the center rail bracket and the rear face of an overlying cover so as to isolate hinge mounting portions at opposite ends of the center rail mounting bracket. The different seals cooperate with each other in preventing undesirable air flow from one compartment to another across metal surfaces in heat transfer association with the outer metal shell.

33 Claims, 5 Drawing Figures

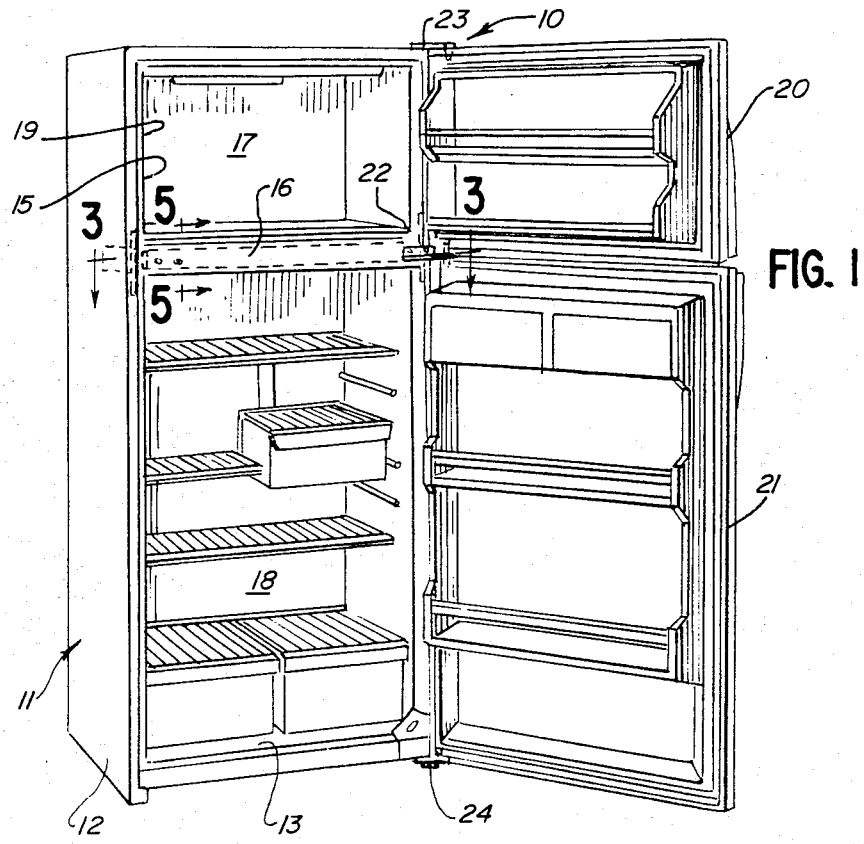
FIG. 1
FIG. 2
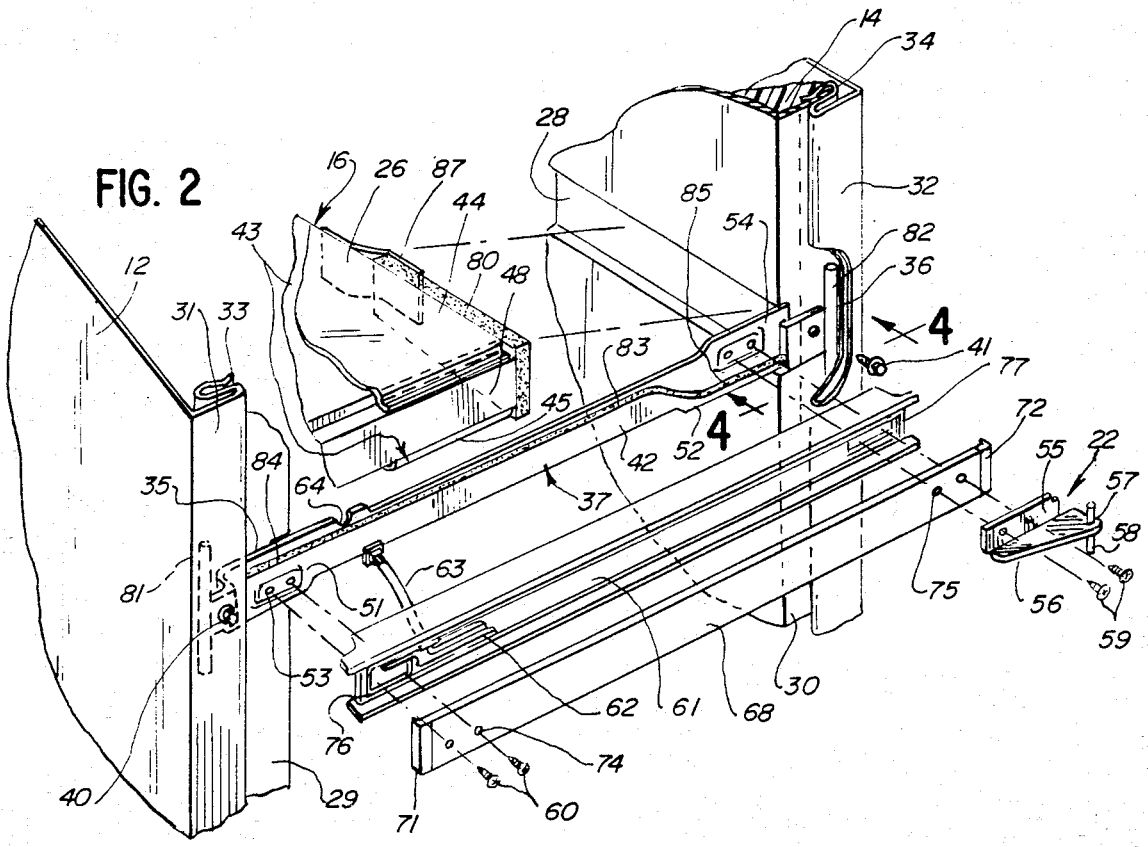

CENTER RAIL ASSEMBLY FOR REFRIGERATOR

BACKGROUND OF THE INVENTION

1. Field of the Invention

This invention relates to refrigerator cabinet assemblies and, in particular, to means for preventing air transfer between different compartments of a refrigerated space defined by a divider wall.

2. Description of the Background Art

In one conventional form of refrigeration apparatus, an insulated cabinet is defined by an outer shell and an inner liner, with insulation, such as foamed-in-place insulation, therebetween. The cabinet defines a space to be refrigerated, with an access opening thereto selectively closed by a door.

In one conventional form of such apparatus, the space is divided into a below-freezing compartment and an above-freezing compartment by a separator wall. The separator wall is retained in the cabinet by a center rail which extends across the access opening. In such a divided compartment refrigeration cabinet structure, a separate door is provided for access selectively to the below-freezing space and above-freezing space. Each of the doors is conventionally carried on pivot hinges, one of the hinges mounted to the cabinet and the other conventionally mounted to the center rail.

The center rail includes end portions which overlap the front edge of the cabinet outwardly of the access opening.

In one form of cabinet construction, the separator wall is received in channels formed in the liner extending rearwardly from the access opening to the rear of the cabinet space.

The center rail normally is covered by a metal cover for aesthetic purposes and for sealing engagement with a magnetic door gasket. Thus, a number of metal surfaces are exposed at the front of the cabinet on which condensation may form and through which heat may enter the refrigerated spaces. It is desirable to eliminate movement of refrigerated air from one refrigerated compartment to the other along a path that would bring the air in contact with the exposed metal surfaces, or in contact with metal parts that are in heat transfer association with exposed metal surfaces, so as to maximize energy consumption efficiency in the operation of the apparatus.

It has been found that because of manufacturing tolerances and the inherent characteristics of such refrigerator cabinet design, a number of air leakage paths may exist between the compartments through which air may migrate from one compartment to the other, particularly under pressure differences, such as introduced by the use of the evaporator fan. Air movement may further occur because of the difference in temperatures between the two compartments. Illustratively, the below-freezing compartment is maintained at approximately 0° F. and the above-freezing temperature compartment may be maintained at approximately 32° F. or more.

The use of seals to prevent air migration between compartments defined by a separator wall in a refrigeration apparatus is known in the art. For example, in U.S. Pat. No. 4,191,434 of John M. Powell et al. a flexible, resilient sealing member 28 is provided along the entire three sides of a separator wall that contact the cabinet liner, to prevent inter-compartment air movement across the sides of the separator wall. The present invention, however, recognizes that such air movement across the sides of the separator wall is not harmful as long as it is not excessive. In fact, such a conventional refrigeration apparatus typically has only one evaporator, located in the below-freezing compartment, and provides ducts and baffles to effect an orderly exchange of refrigerated air between compartments to refrigerate the above-freezing compartment.

The present invention teaches, however, that movement of refrigerated air between compartments will result in a loss of energy consumption efficiency and excessive external condensation formation when the movement occurs along paths that allow the air to flow across metal members which form portions of the outer metal cabinet shell. The moving air extracts a large amount of heat from even a small area of metal with which it comes in contact. This heat enters the refrigerator cabinet and must be extracted by the refrigeration compressor. This flow of heat also causes localized external cold spots that must be heated by anti-sweat heaters, which consume electrical energy and further add undesirable heat to the cabinet, contributing to a lower operating efficiency.

SUMMARY OF THE INVENTION

The present invention comprehends an improved center rail assembly for use in a refrigeration apparatus effectively avoiding the undesirable heat loss and condensation problems of the prior art structures.

The invention comprehends the provision of such a center rail assembly having improved sealing means for preventing air flow against the exposed metal parts of the center rail assembly and the outer metal cabinet shell.

The invention further comprehends means for preventing air flow to the exposed metal parts from the channel receiving the side edges of the separator wall.

More specifically, the invention comprehends the provision of improved sealing means in the channel adjacent the center rail assembly.

In the illustrated embodiment, the sealing means is carried by the side edges of the separator wall.

The invention further comprehends the provision of means for sealing the assembly at the opposite ends of the center rail bracket so as to prevent air flow therearound and in contact with other portions of the metal shell.

In the illustrated embodiment, the opposite ends of the center rail bracket are received in a roll-formed flange portion of the metal shell of the cabinet, and the sealing means is disposed in the roll-formed flange channel in extension around the bracket end.

The invention further comprehends the provision of sealing means disposed between the center rail bracket and a front cover mounted thereto so as to prevent air flow through the space between the bracket and cover.

More specifically, the sealing means is arranged to prevent air flow from the hinge mounting means carried at one end of the center rail bracket to the hinge mounting means carried at the opposite end as well as to prevent air flow transversely across the center rail bracket.

In the illustrated embodiment, the hinge means at one end of the bracket is disposed in an upper portion thereof and the hinge means in the opposite end is disposed in the lower portion thereof, permitting the same hinge to be selectively disposed at either side of the cabinet for mounting the doors for lefthand or righthand opening, as desired. The sealing means, in the illustrated embodiment, extends from above the lower lefthand hinge mounting means to below the upper righthand hinge mounting means.

More specifically, the invention comprehends an improved refrigerator cabinet assembly having a sheet metal outer shell which defines a transverse flange terminating in a channel generally parallel with the flange and opening transversely inwardly, an inner synthetic resin liner having sidewalls and an end wall defining an open ended storage space, the sidewalls terminating with a transverse outwardly turned peripheral flange continuous around its perimeter except for a pair of notches, the flange being received in the channel to support the liner in the shell and to define a wall space, insulation essentially filling the wall space, support means on the liner sidewall adjacent the notches in the peripheral flange, a generally rectangular compartment separator received in the support means and dividing the storage space into an above-freezing compartment and a below-freezing compartment, the separator spaced from the liner sidewalls defining with the support means a horizontal passage forwardly along the sidewalls of the liner, a center rail bracket spanning opposite sides of the face along the front edge of the channel adjacent one of the liner flange notches, wherein the notch, the bracket end and the channel form a duct between the above-freezing compartment and the below-freezing compartment, a center rail cover overlying the entire rail bracket defining a generally horizontal chamber therewith, wherein at least a portion of the cover is metal, the passage, chamber and duct being interconnected and in fluid communication with the above-freezing compartment and the below-freezing compartment, and seal means to prevent air currents across or along any portion of the duct or the chamber, the seal means comprising pad means disposed in the passage which is essentially impermeable to air and covers the transverse area of the passage, rope means disposed in the duct which is essentially impermeable to air and covers the transverse area of the duct, and strip means disposed in the chamber in sealing contact between the center rail bracket and the center rail cover and extending continuously from one corner of the center rail cover to the diagonally opposite corner of the center rail cover.

The present invention provides a system of air leakage path seals preventing air movement from one refrigerated compartment to the other in contact with exposed metal surfaces of the cabinet construction. The sealing means is extremely simple and economical of construction while yet effectively avoiding the problems and disadvantages of the prior art structures as discussed above.

BRIEF DESCRIPTION OF THE DRAWING

Other features and advantages of the invention will be apparent from the following description taken in connection with the accompanying drawing wherein:

FIG. 1 is a perspective view of a refrigerator/freezer apparatus having a center rail assembly embodying the invention;

FIG. 2 is a fragmentary enlarged exploded perspective view illustrating in greater detail the sealing means of the center rail assembly;

DESCRIPTION OF THE PREFERRED EMBODIMENT

Figure 3:
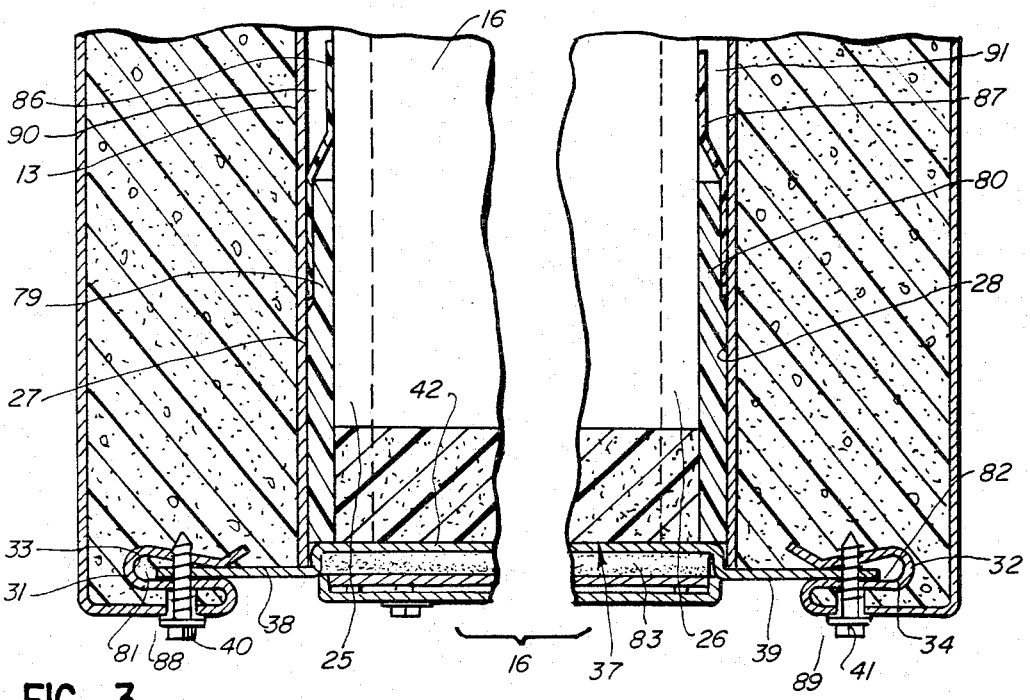
FIG. 3 is a fragmentary horizontal section taken substantially along the line 3—3 of FIG. 1.

In the illustrative embodiment of the invention as disclosed in the drawing, a refrigeration appliance generally designated 10 is shown to include a cabinet 11 defined by an outer metal shell 12 and an inner synthetic resin liner 13 provided with suitable insulation 14 therebetween. Illustratively, the insulation may comprise foamed-in-place insulation.

As seen in FIG. 1, liner 13 defines a space 15 to be refrigerated. A divider, or separator, wall 16 extends across space 15 to divide the space into an upper, below-freezing freezer compartment 17 and a lower above-freezing, fresh food compartment 18.

Space 15 opens from the cabinet 11 through a front access opening 19. An upper door 20 is hingedly mounted to the cabinet for selectively closing the freezer compartment 17 and a lower door 21 is hingedly mounted to the cabinet for selectively closing the fresh food compartment 18.

The means for hingedly mounting the doors to the cabinet includes an intermediate hinge 22 mounted to the cabinet at the separator wall 16, an upper hinge 23 mounted to the top of the cabinet, and a lower hinge 24 mounted to the bottom of the cabinet.

Separator wall 16 comprises a generally rectangular assembly defining side edges 25 and 26. The side edges are slidably received in inwardly opening support channels 27 and 28 at the left and right side of liner 13, respectively. Because of the need to provide manufacturing tolerances and to allow thermal expansion of the separator wall, spaces are left between side edges 25, 26 and channels 27, 28. These spaces define passages 90 and 91 which extend forwardly to the front of separator wall 16.

The liner further defines outturned front flanges 29 and 30. The outer metal shell 12 defines a front, inturned left roll-formed flange 31 and a right, inturned roll-formed flange 32. As seen in FIG. 2, the liner flanges 29 and 30 are received in the inwardly opening channels 33 and 34 of the roll-formed flanges 31 and 32, respectively.

Liner flanges 29 and 30 are provided with notches 35 and 36, respectively, in alignment with the separator wall 16. A center rail bracket 37 extends across the access opening 19 in front of the separator wall 16 and is provided with opposite ends 38 and 39 extending through notches 35 and 36, respectively, to be received in the roll-formed flange channels 33 and 34, respectively, as seen in FIG. 3. As further illustrated in FIG. 3, screws 40 and 41 are extended through ferrules 88 and 89 and into the roll-formed flanges 31 and 32 and bracket ends 38 and 39, respectively, to secure the center rail bracket to the metal shell. As seen in FIG. 3, the bracket ends 38 and 39 are offset forwardly from the midportion 42 of the bracket 37, permitting the midportion 42 to extend intermediate the liner sidewalls in the front end of the channels 27 and 28. As illustrated, bracket midportion 42 bears against the front end of the separator wall to maintain it fixedly in the cabinet with the side edges thereof retained in the channels 27 and 28.

Figure 5:
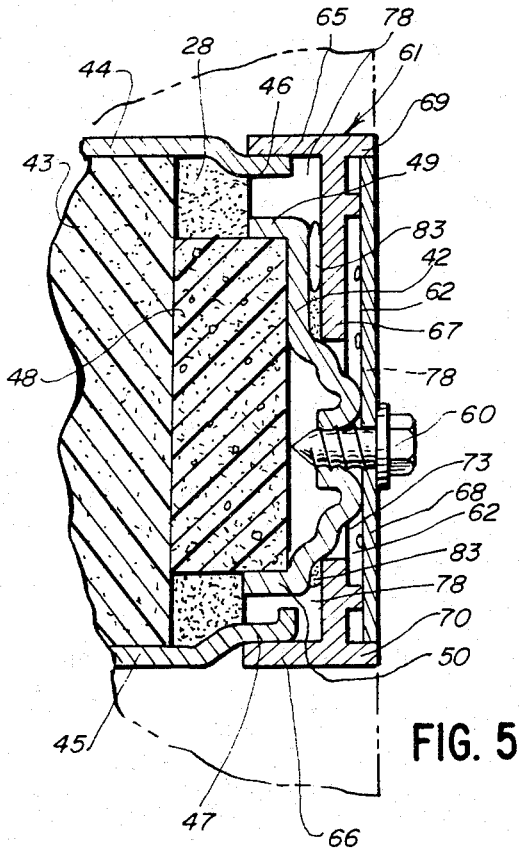
FIG. 5 is a fragmentary enlarged vertical section taken substantially along the line 5—5 of FIG. 1.

As illustrated in FIG. 5, separator wall 16 is formed of a block of rigid insulating material 43, a top plate 44, and a bottom plate 45. The plates may be formed of a suitable synthetic resin or sheet metal, and define, at their front edges, offset flanges 46 and 47, respectively. The separator wall further defines a front block 48 of flexible insulating material against which the center rail bracket midportion 42 bears, as illustrated in FIG. 5. As further shown in FIG. 5, the bracket midportion 42 is provided with a rearwardly turned upper flange 49, and a rearwardly turned lower flange 50 for embracing the block 48.

As best seen in FIG. 2, bracket midportion 42 is provided at its opposite ends with vertically enlarged portions 51 and 52. Enlarged portion 51 defines a hinge mounting portion 53 and enlarged portion 52 defines a hinge mounting portion 54. As shown in FIG. 2, hinge mounting portion 53 is disposed adjacent the lower edge of the lefthand vertically enlarged portion 51, and hinge mounting portion 54 is disposed adjacent the upper edge of the righthand vertically enlarged portion 52. The intermediate hinge 22, as shown in FIG. 2, includes a vertical mounting plate 55 and a horizontal pin mounting plate 56. An upwardly projecting pin 57 and a downwardly projecting pin 58 are provided on the mounting plate 56 for pivotally mounting the lower edge of door 20 and the upper edge of door 21, as shown in FIG. 1.

As indicated briefly above, the cabinet construction 11 is arranged to permit the user to selectively mount the doors 20 and 21 to pivot about either side of the access opening 19, as desired. Thus, in the righthand mounting of the doors, as illustrated in FIG. 1, the mounting plate 55 of hinge 22 is secured to the hinge mounting portion 54 at the righthand side of the center rail bracket by suitable screws 59. To mount the doors to the left hinge mounting portion 53, the hinge 22 is turned upside down so that mounting plate 55 extends downwardly therefrom, thereby positioning the hinge pins 57 and 58 outboard suitably for mounting the lefthand edge of the doors 20 and 21. The vertical offset of the hinge mounting portions 53 and 54 disposes the pin mounting place 56 at the same level when installed thusly in either mounting portion 53 or 54.

A cover 61 is provided for covering center rail bracket 37, as illustrated in FIGS. 2 and 5. A mullion heater 62 is provided on the cover and wiring 63 for the mullion heater is passed through a suitable notch 64 in the bracket enlarged portion 51. As shown in FIG. 5, the cover includes a rearwardly turned top flange 65 and a rearwardly turned bottom flange 66 fitted to the offset flange 46 of top plate 44 and offset flange 47 of bottom plate 45 respectively, in the installed arrangement. The cover further includes a midportion 67 overlying the midportion 42 of the center rail bracket. Cover 61 is preferably formed of a synthetic resin, such as ABS resin.

The cover further includes a metal front plate 68 fitted between a forwardly projecting upper flange 69 and a forwardly projecting lower flange 70. As seen in FIG. 2, the opposite ends 71 and 72 of the front plate 68 are rearwardly turned to enclose the space 73 between the front plate and the cover midportion 67. Space 73 is occupied by mullion heater 62.

As illustrated in FIGS. 2 and 5, front plate 68 is provided with suitable left apertures 74 and right apertures 75 for passing the screws 60 and 59, respectively therethrough. Cover 61 is provided with suitable openings 76 and 77 overlying the hinge mounting portions 53 and 54, respectively, for accommodating the hinge mounting portions and for receiving the screws 60 and 59, respectively.

The invention comprehends providing a number of seals for preventing air flow between compartments 17 and 18 along paths that would direct the refrigerated air across metal surfaces in thermal contact with the outside of the cabinet metal shell. The air flow would be generated by the temperature and pressure differences between the compartments.

Figure 4:
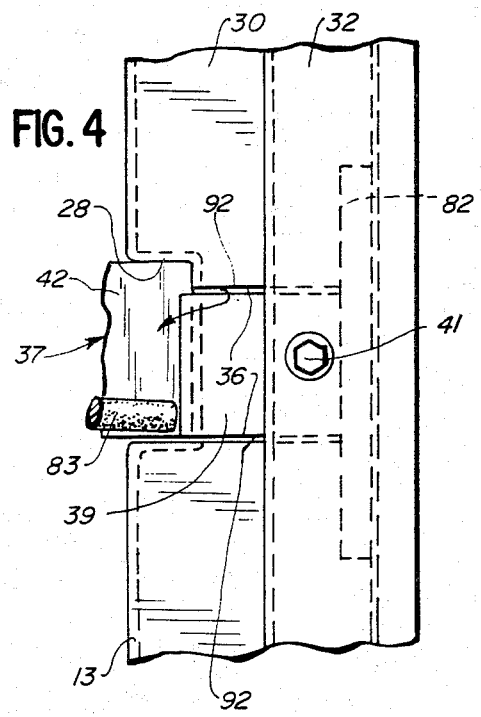
FIG. 4 is a fragmentary elevation taken substantially along the line 4—4 of FIG. 2.

As shown in FIG. 4, the center rail bracket ends 38 and 39 have a height slightly less than the height of the notches 35 and 36 respectively. Further, as seen in FIGS. 3 and 4, the center rail bracket ends do not extend fully into the roll-formed flange channels 33 and 34. Possible intercompartment leakage paths for air may be established through ducts 92 extending from the below-freezing compartment to the top of notches 35 and 36 then around the center rail bracket ends, through the channels 33 and 34 and finally through the bottom of notches 35 and 36 to the above-freezing compartment. As seen in FIGS. 3 and 4, such an air leakage path would bring refrigerated air directly into contact with channels 33 and 34 which are integrally formed with outer metal shell 12. This air flow over the metallic surface would tend to cause thermal loss and condensation on metal shell 12 in the vicinity of the separator wall.

Similarly, a possible intercompartment leakage path exists through the space, or chamber, 78 between the center rail bracket and the rear surface of the cover 61. The resultant air flow across the center rail bracket would create a thermal loss and condensation problem on metal front plate 68 and the metal shell 12, both of which are in heat transfer association with center rail bracket 37.

The possible air leakage path through space 78 exists because either end of space 78 may be in air leakage communication with one compartment 17 or 18, and the opposite end of space 78 may be in communication with the other compartment. This arrangement would generate a generally horizontal air flow across the center rail bracket. Alternatively, the top edge of one end of space 78 may be in air leakage communication with one compartment 17 or 18 and the bottom edge of the same end may be in air leakage communication with the other compartment. This latter arrangement would generate a vertical air flow across the one end of the bracket. Of course, a combination of the above arrangements could occur. The contorted shape of the center rail bracket, with the vertically enlarged portions and hinge mounting portions at both ends, increases the likelihood that an air leakage path may be established between space 78 and the compartments.

An additional intercompartment air leakage path can be established through passages 90 and 91. As previously explained, air flow directly between the compartments vertically across passages 90 and 91 is not harmful because the air will not contact metal portions of the cabinet shell. However, refrigerated air which enters passages 90 and 91 from one of the compartments can flow horizontally forwardly through the passages and enter air leakage ducts 92 at the ends of the center rail bracket or chamber 78 between the center rail bracket and cover 61. Conversely, air flowing through ducts 92 or through chamber 78 could use passages 90 and 91 for a return path to one of the chambers.

It is thus seen that the intercompartment air flow paths are complex and interconnected. To prevent such air flow, a first sealing means is provided in the form of insulating pads 79 and 80 secured to the side edges of divider wall 16 forwardly adjacent the center rail bracket by suitable adhesive tape strips 86 and 87. The pads are compressed in passages 90 and 91 between the side edges of the wall 16 and the bight of channels 27 and 28 so as to effectively preclude air flow through the passages forwardly to notches 35 and 36 or space 78.

A second sealing means is provided in the form of sealing ropes 81 and 82 extending vertically in the roll-formed flange channels 33 and 34 about the inserted bracket ends 38 and 39, respectively. As shown in FIG. 4, ropes 81 and 82 are arranged to extend about the bracket ends outwardly of securing screws 41 and vertically beyond the tops and bottoms of notches 35 and 36, respectively.

A third seal is provided in the form of a compressible sealing strip 83 extending lengthwise of the center rail bracket. The strip is compressed between the front face of bracket 37 and the rear face of cover 61, as best seen in FIG. 5. As shown in FIG. 2, the lefthand end 84 of the strip is disposed above the lefthand hinge mounting portion 53 and the righthand end 85 of the strip is disposed below the righthand hinge mounting portion 54 of the center rail bracket, whereby the two vertically enlarged portions are sealingly isolated from each other and each is isolated from at least one compartment 17, 18, thereby precluding air flow either horizontally along, or vertically across, bracket 37. Thus, air flow in contact with the exposed center rail bracket 37 is effectively precluded, thereby avoiding the thermal loss and condensation problems discussed above. Sealing strip 83 is formed, in the illustrated embodiment, of a polyfoam tape. The sealing ropes 81 and 82 may be formed of any suitable flexible air-impervious synthetic resin material, as desired. The pads 79 and 80 may comprise any suitable compressible, air-impervious sealant synthetic resin as desired.

The seals of the present invention, as discussed above, are extremely simple and economical while yet providing effectively positive air flow prevention along the above discussed potential air flow paths. As these paths are interconnected, the plural seals cooperate with each other as a system of seals in defining the total means for preventing the undesirable air flow. Because of the interconnection, the air leakage paths are complex. However, it has been found that by utilizing the above discussed three seals, substantial prevention of such undesirable air flow is obtained.

The foregoing disclosure of specific embodiments is illustrative of the broad inventive concepts comprehended by the invention.

We claim:

1. In a refrigerator cabinet assembly having a sheet metal outer shell which defines a transverse flange terminating in a channel generally parallel with said flange and opening transversely inwardly, a liner having sidewalls and an end wall defining an open-ended storage space, said sidewalls terminating with a transverse outwardly turned peripheral flange continuous around its perimeter except for a pair of notches, said flange being received in said channel to support said liner in said shell and to define a wall space, and insulation essentially filling said wall space, the improvement comprising:

support means on said liner sidewall adjacent said notches;

a generally rectangular compartment separator received in said support means and dividing said storage space into an above-freezing compartment and a below-freezing compartment, said separator spaced from said liner sidewalls defining a horizontal passage forwardly along the sidewalls of said liner;

a center rail bracket spanning opposite sides of said wall space along the front edge of said channel adjacent one of said liner flange notches, wherein said notch, one end of said bracket and said channel form a duct between said above-freezing compartment and said below-freezing compartment;

a center rail cover overlying said center rail bracket defining a generally horizontal chamber therewith, wherein at least a portion of said cover is metal, said passage, said chamber, and said duct being interconnected and in fluid communication with said above-freezing compartment and said below-freezing compartment; and seal means to prevent air currents across or along any portion of said duct or said chamber.

2. The refrigerator cabinet assembly of claim 1 wherein said seal means comprises rope means disposed in said duct which is essentially impermeable to air and covers the transverse area of said duct, and strip means disposed in said chamber in sealing contact between said center rail bracket and said center rail cover and extending continuously from one corner of said center rail cover to the diagonally opposite corner of said center rail cover.

3. The refrigerator cabinet assembly of claim 2 further including pad means disposed in said passage which is essentially impermeable to air and covers the transverse area of said passage.

4. The refrigerator cabinet assembly of claim 3 wherein said pad means has a length substantially less than that of said passage and is disposed adjacent said center rail bracket.

5. The refrigerator cabinet assembly of claim 2 wherein said rope means embraces an end portion of said center rail bracket in said duct.

6. The refrigerator cabinet assembly of claim 2 wherein said center rail bracket defines opposite offset end portions and said strip means extends between said end portions.

7. In a refrigerator cabinet having a liner defining sidewalls and a separator wall having opposite side edge portions and a transverse edge portion between said side edge portions, said liner sidewall defining opposite aligned support channels receiving said separator wall side edge portions, the spacing between the bottoms of the channels being greater than the width of said separator wall between said side edge portions, the improvement comprising:

a pair of insulating pads, each having a length less than that of said channels; and means for mounting said pads one each to said opposite separator wall edge portions adjacent said transverse edge portion to be sealingly compressed between said side edge portions and said liner sidewalls in said channels to completely block the transverse area therebetween and thereby preclude air flow through said channels to said transverse edge portion.

8. The refrigeration cabinet of claim 7 wherein each said means for mounting said pads comprises adhesive tape means.

9. The refrigeration cabinet of claim 7 wherein each said means for mounting said pads comprises adhesive tape means secured to one end of the pad and to said side edge portion of said separator wall within said channel.

10. The refrigeration cabinet of claim 7 wherein each said means for mounting said pads comprises adhesive tape formed of a synthetic resin.

11. The refrigeration cabinet of claim 7 wherein each said means for mounting said pads comprises adhesive tape extending the height of said support channel.

12. The refrigeration cabinet of claim 7 wherein each said means for mounting said pads comprises adhesive tape having a portion captured between said pad and said liner sidewall in said support channel.

13. The refrigeration cabinet of claim 7 further including a transverse bracket extending along said transverse edge portion of said separator wall and outwardly beyond the opposite side edge portion, said pads defining ends abutting said bracket.

14. In a refrigeration cabinet having a shell provided with opposite inturned flange portions defining opposed roll-formed channels, a liner within said shell defining an internal cabinet space and having outturned edge flange portions received in said channels, and a divider wall extending across the cabinet space to divide the space into adjacent compartments, said divider wall defining a front edge portion, the improvement comprising:

a center rail bracket extending across said front edge portion of said divider wall and having opposite ends received in said roll-formed channels of said shell inturned flange portions, each said liner outturned flange portions being provided with a gap through which one of said ends of said bracket extends; and sealing means in each said channel for preventing air flow through said gap and channel past the said bracket end received in said channel.

15. The refrigeration cabinet of claim 14 wherein each said sealing means comprises a rope seal.

16. The refrigeration cabinet of claim 14 wherein each said sealing means comprises an elongated seal element having opposite ends extending beyond said liner outturned flange gap at opposite edges of said bracket end.

17. The refrigeration cabinet of claim 14 wherein each said sealing means comprises an elongated seal element having opposite ends extending beyond said liner outturned flange gap at opposite edges of said bracket end and a midportion compressed sealingly between said bracket end and a portion of said inturned shell flange at the outer end of said channel.

18. The refrigeration cabinet of claim 14 wherein each said sealing means comprises means compressed sealingly between said bracket end and a portion of said inturned shell flange at the outer end of said channel.

19. The refrigeration cabinet of claim 14 further including threaded securing means extending through each said shell flange and mounting bracket end associated therewith.

20. The refrigeration cabinet of claim 14 wherein said bracket ends have a height substantially equal to the height of said gap.

21. The refrigeration cabinet of claim 14 wherein said bracket ends have a height substantially equal to the height of said divider wall.

22. In a refrigeration cabinet having a liner defining an internal cabinet space, and a divider wall dividing the cabinet space into adjacent compartments, the improvement comprising:

a bracket extending along an edge of said divider wall and having end portions secured to said cabinet;

a bracket cover fitted to said divider wall edge and enclosing said bracket; and elongated sealing means extending longitudinally between diagonally opposite portions of said bracket at said end portions and transversely sealingly between said bracket and cover for preventing intercompartment air flow between said bracket and cover, said sealing means having a width transversely to the longitudinal extent of the bracket substantially less than the corresponding dimension of the bracket whereby the sealing means occupies only a small portion of the space between the cover and bracket.

23. The refrigeration cabinet of claim 22 wherein said sealing means comprises a strip of polyfoam tape.

24. The refrigeration cabinet of claim 22 wherein said cover is provided with a metal insert.

25. The refrigeration cabinet of claim 22 wherein said bracket has a height less than the height of said divider wall.

26. The refrigeration cabinet of claim 22 wherein said bracket has a height less than the height of said divider wall and an insulation member having a height similar to that of said bracket is disposed between said bracket and divider wall.

27. The refrigeration cabinet of claim 22 wherein said divider wall is provided with a top panel and a bottom panel and said cover extends between said top panel and said bottom panel.

28. In a refrigerator structure having a cabinet defining a refrigeration space and a front access opening to said space, and a horizontal divider wall extending across said space and defining a front edge thereof, the improvement comprising:

a bracket having opposite ends secured to said cabinet at opposite sides of said access opening to overlie said divider wall front edge;

a first hinge support on a top portion of said bracket adjacent one of said opposite ends thereof;

a second hinge support on a bottom portion of said bracket adjacent the opposite end thereof;

a cover overlying said bracket and defining a space therebetween; and sealing means providing a seal between said bracket and cover for preventing air flow between said hinge supports through said space.

29. The refrigerator structure of claim 28 wherein said sealing means comprises a narrow flexible strip of sealing material.

30. The refrigerator cabinet structure of claim 28 wherein said sealing means comprises polyfoam tape.

31. The refrigerator cabinet structure of claim 28 wherein said sealing means extends longitudinally across said bracket and has one end portion subjacent said first hinge support and an opposite end portion superjacent said second hinge support.

32. The refrigerator cabinet structure of claim 28 wherein said bracket includes offset end portions and said sealing means abuts said end portions.

33. In a refrigerator cabinet assembly having a sheet metal outer shell which defines a transverse flange terminating in a roll-formed channel generally parallel with said flange and opening transversely inwardly, a synthetic resin liner having sidewalls and an end wall defining an open-ended storage space, said sidewalls terminating with a transverse outwardly turned front flange continuous around its perimeter except for a pair of notches, said flange being received in said roll-formed channel to support said liner in said shell and to define a wall space, and insulation essentially filling said wall space, the improvement comprising:

opposite aligned horizontal support channels formed in said liner sidewalls adjacent said notches;

a generally rectangular compartment separator wall received in said horizontal support channels and dividing said storage space into an above-freezing compartment and a below-freezing compartment, said separator spaced from said liner sidewalls defining a horizontal passage forwardly along said liner sidewalls;

a center rail bracket spanning opposite sides of said wall space along the front edge of said roll-formed channel and extending through one of said liner flange notches, wherein said notch, one end of said bracket and said roll-formed channel form a duct between said above-freezing compartment and said below-freezing compartment;

a center rail cover overlying said center rail bracket defining a generally horizontal chamber therewith, wherein at least a portion of said cover is metal, said passage, said chamber, and said duct being interconnected and in fluid communication with said above-freezing compartment and said below-freezing compartment; and a system of seals to prevent air currents across or along any portion of said duct or said chamber, said system comprising a flexible foam pad disposed in said passage adjacent said bracket wherein said pad is essentially impermeable to air and covers the transverse area of said passage, a flexible rope seal disposed in said duct wherein said rope seal is essentially impermeable to air and covers the transverse area of said duct, and a sealing strip disposed in said chamber in sealing contact between said center rail bracket and said center rail cover wherein said sealing strip is a polyfoam tape and extends continuously from one corner of said center rail cover to the diagonally opposite corner of said center rail cover.

* * * * *